United States Patent [19]

Sorensen et al.

[11] Patent Number: 4,958,266

[45] Date of Patent: Sep. 18, 1990

[54] LAMP HAVING AN IMPROVED BULB MOUNTING MEMBER

[75] Inventors: Robert C. Sorensen, Burr Ridge; Thomas S. Hendrickson, Crestwood, both of Ill.

[73] Assignee: RCS Industries, Inc., Alsip, Ill.

[21] Appl. No.: 459,967

[22] Filed: Jan. 2, 1990

[51] Int. Cl.[5] ..... F21V 7/02

[52] U.S. Cl. ..... 362/310; 362/448; 313/318

[58] Field of Search ..... 362/226, 310, 362, 448; 313/318

[56] References Cited

U.S. PATENT DOCUMENTS

| | | | |
|---|---|---|---|
| 4,336,577 | 6/1982 | Hanson | 362/310 X |
| 4,547,838 | 10/1985 | Wakimizu | 362/310 X |
| 4,647,809 | 3/1987 | Blaisdell et al. | 313/318 X |

*Primary Examiner*—Stephen F. Husar

*Attorney, Agent, or Firm*—Emrich & Dithmar

[57] ABSTRACT

The lamp comprises a frustoconical outer envelope. A bulb mounting member includes a flange disposed against or adjacent to the rear portion of the outer envelope and a post which protrudes through an opening in such rear portion into the interior of the outer evelope. A lamp base is secured to the rear portion of the outer evelope. A bulb is secured to the inner end of the post.

11 Claims, 1 Drawing Sheet

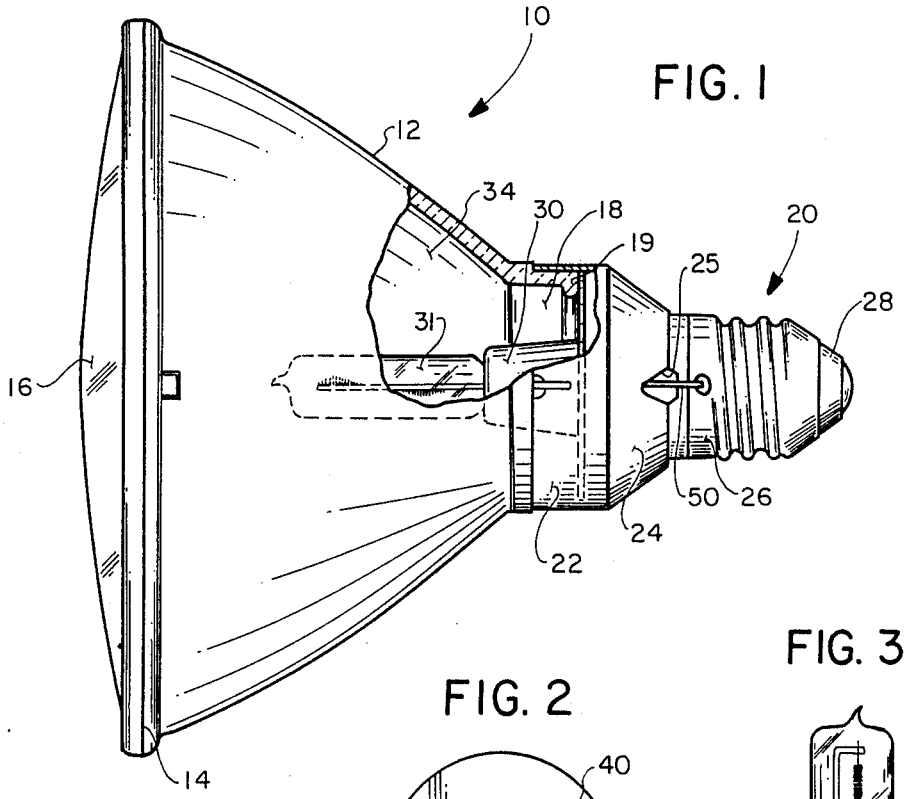
FIG. 1
FIG. 2
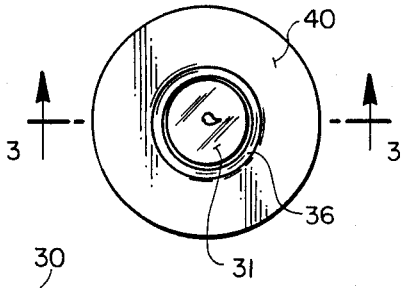
FIG. 3
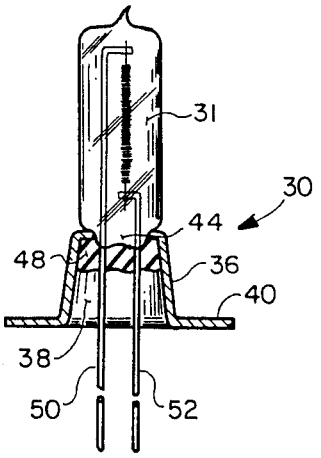
FIG. 4
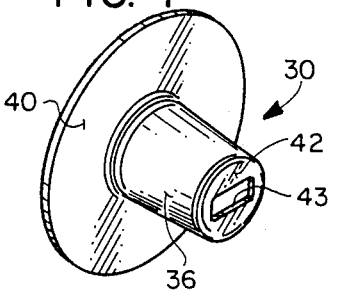
FIG. 5
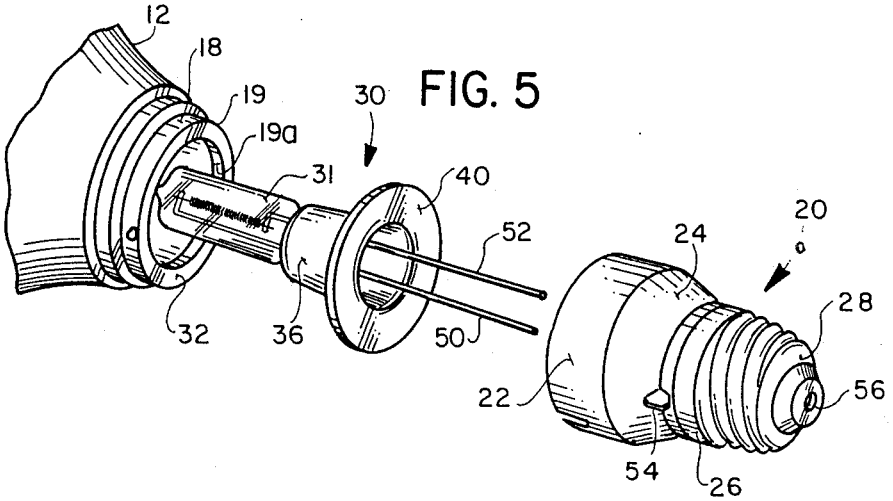

LAMP HAVING AN IMPROVED BULB MOUNTING MEMBER

BACKGROUND OF THE INVENTION

The present invention relates generally to a lamp and, more particularly, to a lamp having an improved bulb mounting member.

A lamp used in display lighting, for example, includes an outer reflective envelope, a lamp base attached to the rear of the envelope and a bulb mounted in the base. At the rear of the envelope is a radially inwardly extending wall which has a pair of openings, a pair of cups being seated therein. Two heavy mounting wires, which are brazed to the cups, extend through the pair of cups and into the envelope. The bulb includes a pair of lead wires which are soldered to the mounting wires. Another pair of lead wires, located within the lamp base, are connected to the mounting wires and to the lamp base.

A disadvantage of such a lamp is the complicated manufacturing process necessitated by having to attach two pairs of lead wires to the mounting wires and having to braze the mounting wires. A further disadvantage is the need to carefully align the bulb within the envelope.

SUMMARY OF THE INVENTION

It is a general object of the present invention to provide a lamp having a bulb mounting member which avoids the disadvantages of prior lamps while affording additional structural advantages.

Another object is to reduce the cost of manufacturing a lamp which includes a bulb mounted at the rear of the lamp's outer envelope.

Another object is to provide a lamp having improved lighting efficiency.

Another object is to provide a lamp wherein the bulb is automatically aligned within the outer envelope without having to adjust the bulb position.

In summary, there is provided a lamp comprising an outer envelope defining a space, the outer envelope including front and rear portions and an opening through the rear portion, a one-piece bulb mounting member including a hollow post and a radially outwardly extending flange formed at one end thereof, the flange being disposed against the rear portion and the post protruding through the opening and into the space, a bulb secured to the other end of the post and including lead wires extending through the interior of the post, and a lamp base secured to the rear portion and electrically connected to the lead wires.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

FIG. 1 is a side elevational view of a lamp constructed in accordance with the features of the present invention, with a portion broken away to expose its interior;

FIG. 2 is an end view of the bulb mounting member in FIG. 1;

FIG. 3 is a cross-sectional view of the bulb mounting member with the bulb secured thereto, taken along the line 3—3 of FIG. 2;

FIG. 4 is a perspective view of the bulb mounting member; and

FIG. 5 is an exploded view of the lamp, a fragment of the envelope being shown.

DETAILED DESCRIPTION OF THE PREFERRED EMBODIMENT

Turning now to the drawings and more particularly to FIG. 1 thereof, there is depicted a lamp, generally designated 10, constructed in accordance with the present invention. The lamp 10 comprises an outer envelope 12 which, in the embodiment depicted, is generally frustoconical in shape. The interior thereof is metallized to provide a reflector for the light created by the bulb therein. Attached to the front portion 14 of the envelope 12 is a light-transmitting plate or lens 16. The envelope 12 and the lens 16 are basically standard items. The principles of the present invention could be utilized with other types of envelopes.

The rear portion 18 of the outer envelope 12 has a radially inwardly directed wall 19 and an opening **19*a* (FIG. 5) therethrough. The lamp 10 comprises a lamp base 20, which, in the embodiment shown, is constructed of brass sheet and stamped into the shape shown. It includes a shell member 22 matching the shape of the rear portion 18 of the outer envelope 12. The shell member 22 has a frustoconical wall 24 to which a threaded member 26 is connected. In the wall 24 is an opening 25. The lamp base 20 includes a head 28 formed at the end of the threaded member 26**.

The lamp 10 also comprises a one-piece bulb mounting member 30, for mounting a bulb 31. Referring FIGS. 2–5, the bulb mounting member 30 includes a hollow post 36 having a hollow interior 38 (FIG. 3) and a radially outwardly extending flange 40, in the form of an annular ring, integrally formed at one end of the post 36. In the embodiment shown, the post is generally frustoconical. The bulb mounting member 30 further includes a radially inwardly extending wall 42 integrally formed at the other end of the post 36. The wall 42 has an opening 43 therein. The flange 40 is secured to base 20. When base 20 is attached to envelope 12, flange 40 is disposed against or adjacent to wall 18 at the rear of the outer envelope 12. The post 36 protrudes through the opening **19*a* and into the interior of the outer envelope 12**.

The bulb 31 includes a bulb base 44 which protrudes through the opening 43. As shown in FIG. 3, the bulb base 44 extends partially into the interior 38 of the post 36. A mass of thermoplastic material 48 or ceramic adhesive is located within the post interior 38 and surrounds the bulb base 44 to help secure it to the mounting member 30.

Lead wires 50 and 52 from the bulb base 44 extend through the post interior 38. The lead wire 50 terminates at the opening 25 in the shell member 22 and is secured, by means of soldering or the like, to the threaded member 26 of the lamp base 20.

The lead wire 52 extends through the interior of the lamp base 20 and into an opening 56 formed in the head 28 of the lamp base 20. The lead wire 52 is secured within the opening 56 by means of soldering or the like.

Simply attaching the lamp base 20 to the envelope 12 automatically aligns the bulb 31 such that the need for adjustment of the bulb 31 is obviated.

What has been described therefore is a lamp having an improved bulb mounting member. While a particular embodiment of this invention has been described, it is to be understood that changes can be made in such embodiment without departing from the spirit or scope of the invention as defined in the claims.

What is claimed is:

1. A lamp comprising an outer envelope defining a space, said outer envelope including front and rear portions and an opening through said rear portion, a one-piece bulb mounting member including a hollow post and a radially outwardly extending flange formed at one end thereof, said flange being adjacent to said rear portion and said post protruding through said opening and into said space, a bulb secured to the other end of said post and including lead wires extending through the interior of said post, and a lamp base secured to said rear portion and electrically connected to said lead wires.

2. The lamp of claim 1, wherein said outer envelope is a reflector.

3. The lamp of claim 2, wherein said reflector is generally frustoconical and has a metallized interior.

4. The lamp of claim 1, wherein said post is frustoconical.

5. The lamp of claim 1, wherein said mounting member further includes a radially inwardly extending wall formed at the other end of said post, said wall having an opening therein, said bulb being seated against said wall, said bulb including a bulb base protruding through said opening and extending partially into the interior of said post.

6. The lamp of claim 5, and further comprising a mass of thermoplastic material located within the interior of said post and surrounding said base of said bulb to help to secure said bulb to said bulb mounting member.

7. The lamp of claim 1, wherein said lamp base includes a threaded member and a shell member, said shell member surrounding said rear portion.

8. The lamp of claim 7, wherein said lamp base includes a head formed at an end of said threaded member, said head having an opening, one of said lead wires extending into said opening, and being secured within said opening.

9. The lamp of claim 8, wherein said shell member includes an opening therein, the other of said lead wires extending through said opening and being secured to said threaded member.

10. The lamp of claim 1, wherein said outer envelope includes a radially extending wall formed at said rear portion, said flange being disposed against said radially extending wall.

11. The lamp of claim 1, wherein said flange is annular.

* * * * *